US008316997B2

(12) United States Patent
Mitsuda et al.

(10) Patent No.: US 8,316,997 B2
(45) Date of Patent: Nov. 27, 2012

(54) ELEVATOR GROUP CONTROL SYSTEM

(75) Inventors: Masayuki Mitsuda, Aichi (JP); Yoshimasa Koba, Tokyo (JP); Koji Takeshima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 300 days.

(21) Appl. No.: 12/918,186

(22) PCT Filed: May 21, 2008

(86) PCT No.: PCT/JP2008/059325

§ 371 (c)(1),
(2), (4) Date: Aug. 18, 2010

(87) PCT Pub. No.: WO2009/141900

PCT Pub. Date: Nov. 26, 2009

(65) Prior Publication Data

US 2010/0326773 A1 Dec. 30, 2010

(51) Int. Cl.
*B66B 1/20* (2006.01)

(52) U.S. Cl. ..... 187/384; 187/392

(58) Field of Classification Search ..... 187/380–389, 187/391–393

See application file for complete search history.

(56) References Cited

U.S. PATENT DOCUMENTS

| | | | | |
|---|---|---|---|---|
| 5,345,049 | A * | 9/1994 | Bahjat et al. | 187/382 |
| 6,553,269 | B1 * | 4/2003 | Hikita | 700/48 |
| 6,672,431 | B2 * | 1/2004 | Brand et al. | 187/382 |
| 6,808,049 | B2 * | 10/2004 | Brand et al. | 187/383 |
| 7,014,015 | B2 * | 3/2006 | Nikovski et al. | 187/382 |
| 7,281,610 | B2 * | 10/2007 | Ylinen et al. | 187/382 |
| 7,921,968 | B2 * | 4/2011 | Stanley et al. | 187/388 |
| 8,047,334 | B2 * | 11/2011 | Christy et al. | 187/384 |
| 8,157,059 | B2 * | 4/2012 | Takeuchi et al. | 187/396 |
| 2001/0035314 | A1 * | 11/2001 | Yoshida et al. | 187/382 |

FOREIGN PATENT DOCUMENTS

| | | |
|---|---|---|
| JP | 64 43475 | 2/1989 |
| JP | 9 118483 | 5/1997 |
| JP | 2001 063927 | 3/2001 |
| JP | 2004 250150 | 9/2004 |
| JP | 2005 219840 | 8/2005 |
| JP | 2007 518652 | 7/2007 |

OTHER PUBLICATIONS

U.S. Appl. No. 13/395,909, filed Mar. 14, 2012, Koba.
U.S. Appl. No. 13/496,048, filed Mar. 14, 2012, Koba, et al.
U.S. Appl. No. 13/510,326, filed May 17, 2012, Mitsuda, et al.

* cited by examiner

*Primary Examiner* — Anthony Salata
(74) *Attorney, Agent, or Firm* — Oblon, Spivak, McClelland, Maier & Neustadt, L.L.P.

(57) ABSTRACT

Provided is an elevator group control system which is excellent in convenience and can prevent a decrease in operation efficiency even when an elevator is used by a group of a plurality of persons. For this purpose, there are installed in an elevator hall a destination operating panel by use of which users register their destination floors before boarding and a group boarding registering device for registering that users use an elevator as a group. The number of users expected when users use an elevator as a group is stored beforehand in a user head-count storage section. When registration of a destination floor by use of the destination operating panel has been performed at the same time with registration of a group use by use of the group boarding registering device, a car to be assigned to a hall car call is determined on the basis of the number of users stored in the user head-count storage section.

8 Claims, 5 Drawing Sheets

ELEVATOR GROUP CONTROL SYSTEM

TECHNICAL FIELD

The present invention relates to an elevator group control system which group-controls a plurality of elevators and by use of which users can register their destination floors (hall car calls) in an elevator hall.

BACKGROUND ART

In buildings and the like where there are many elevator users, a plurality of elevators are installed within the same building and these plurality of elevators are group-controlled in order to improve the operation efficiency of all elevators. A conventional art of an elevator group control system which performs such group control is described in Patent Document 1 below.

This elevator group control system is configured to permit registration of a destination floor and the number of persons as a group (the number of users) before boarding so that the users as a group of a plurality of persons can use an elevator comfortably. That is, when a representative of the group inputs a destination floor and the number of users via a destination operating panel, a group supervisory controller assigns a car having a vacancy for the number of users to the hall car call.

Patent Document 1: Japanese Patent Publication of PCT International Application No. 277-518652.

DISCLOSURE OF THE INVENTION

Problems to be Solved by the Invention

In the system described in Patent Document 1, when users as a group use an elevator, a representative of the group had to perform the work of confirming the number of users before inputting the number of users via a destination operating panel. For this reason, this confirmation work was burdensome, posing the problem of poor convenience.

Furthermore, if a large value is inputted as the number of users, the users had to wait in a hall until a vacancy for the number of users occurs in a car. In such a case, it is necessary to create the vacancy for the number of users in an assigned car, posing also the problem of a very low operation efficiency.

The present invention has been made to solve problems as described above and the object of the invention is to provide an elevator group control system which is excellent in convenience and can prevent a decrease in operation efficiency even when an elevator is used by a group of a plurality of persons.

Means for Solving the Problems

An elevator group control system of the present invention is an elevator group control system that group-controls a plurality of elevators, which comprises a destination operating panel which is provided in an elevator hall and from which users register their destination floors before boarding, a group boarding registering device for registering that users will use an elevator as a group, which is provided in the hall, a user head-count storage section in which the number of users expected when an elevator is used by users as a group is stored beforehand, and an assigned car determination section which determines a car to be assigned to a hall car call on the basis of the number of users stored in the user head-count storage section when registration of a destination floor by use of the destination operating panel has been performed at the same time with registration of a group use by use of the group boarding registering device.

Effect of the Invention

According to the present invention, in an elevator group control system which group-controls a plurality of elevators, it becomes possible to ensure excellent convenience and to prevent a decrease in operation efficiency even when a group of a plurality of persons uses an elevator.

BRIEF OF DESCRIPTION OF THE DRAWINGS

DESCRIPTION OF SYMBOLS

1 destination operating panel, 2 destination operating button,
3 group button, 4 handicapped people button,
5 group supervisory controller, 6 controller,
7 car load detector,
8 car load increase detection section,
9 user head-count storage section,
10 assigned car determination section,
11 group user head-count calculating section,
12 user head-count learning section,
13 time-zone-based user head-count changeover section

BEST MODE FOR CARRYING OUT THE INVENTION

The present invention will be described in more detail with reference to the accompanying drawings. Incidentally, in each of the drawings, like numerals refer to like or similar parts and overlaps of description of these parts are appropriately simplified or omitted.

First Embodiment

Figure 1:
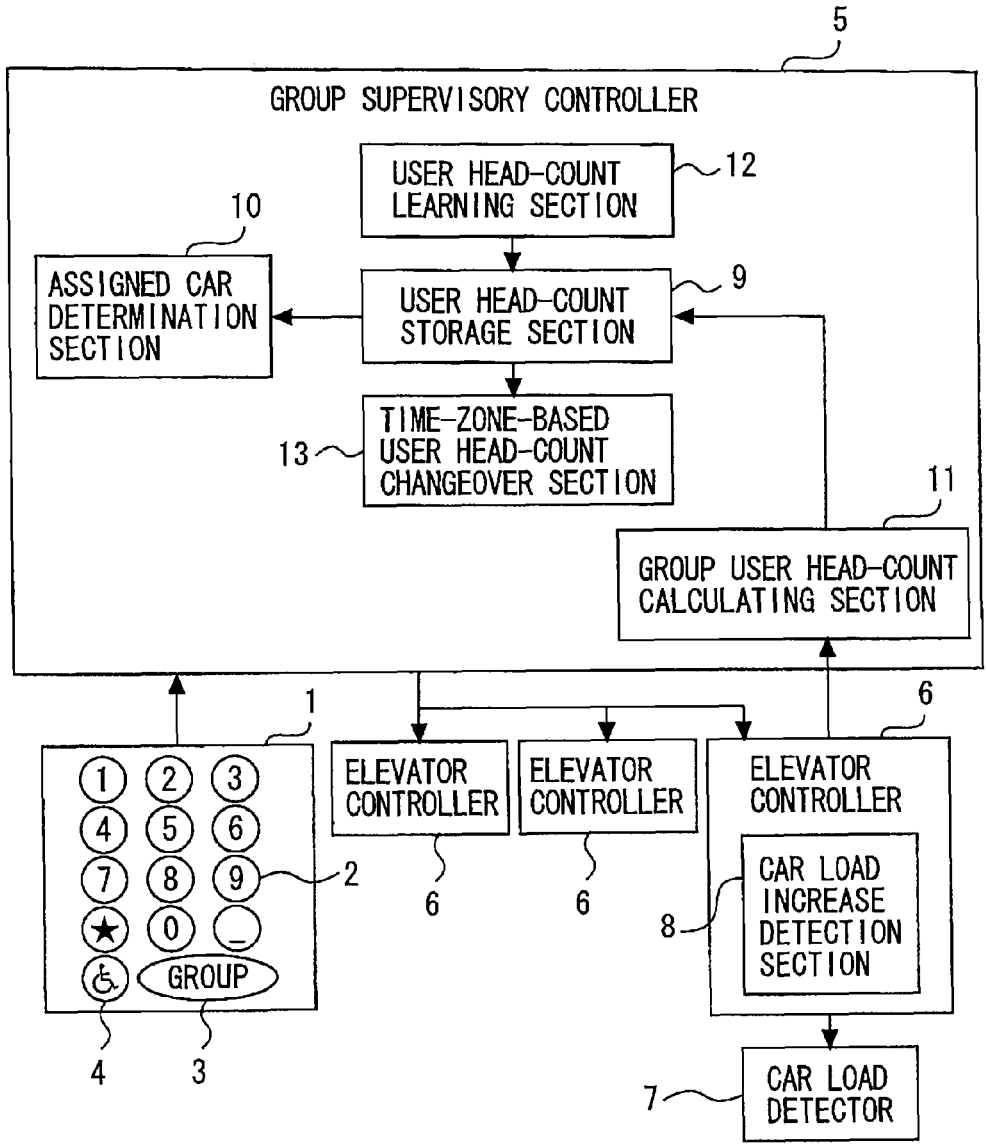
FIG. 1 is a block diagram showing an elevator group control system in a first embodiment according to the present invention.
Figure 2:
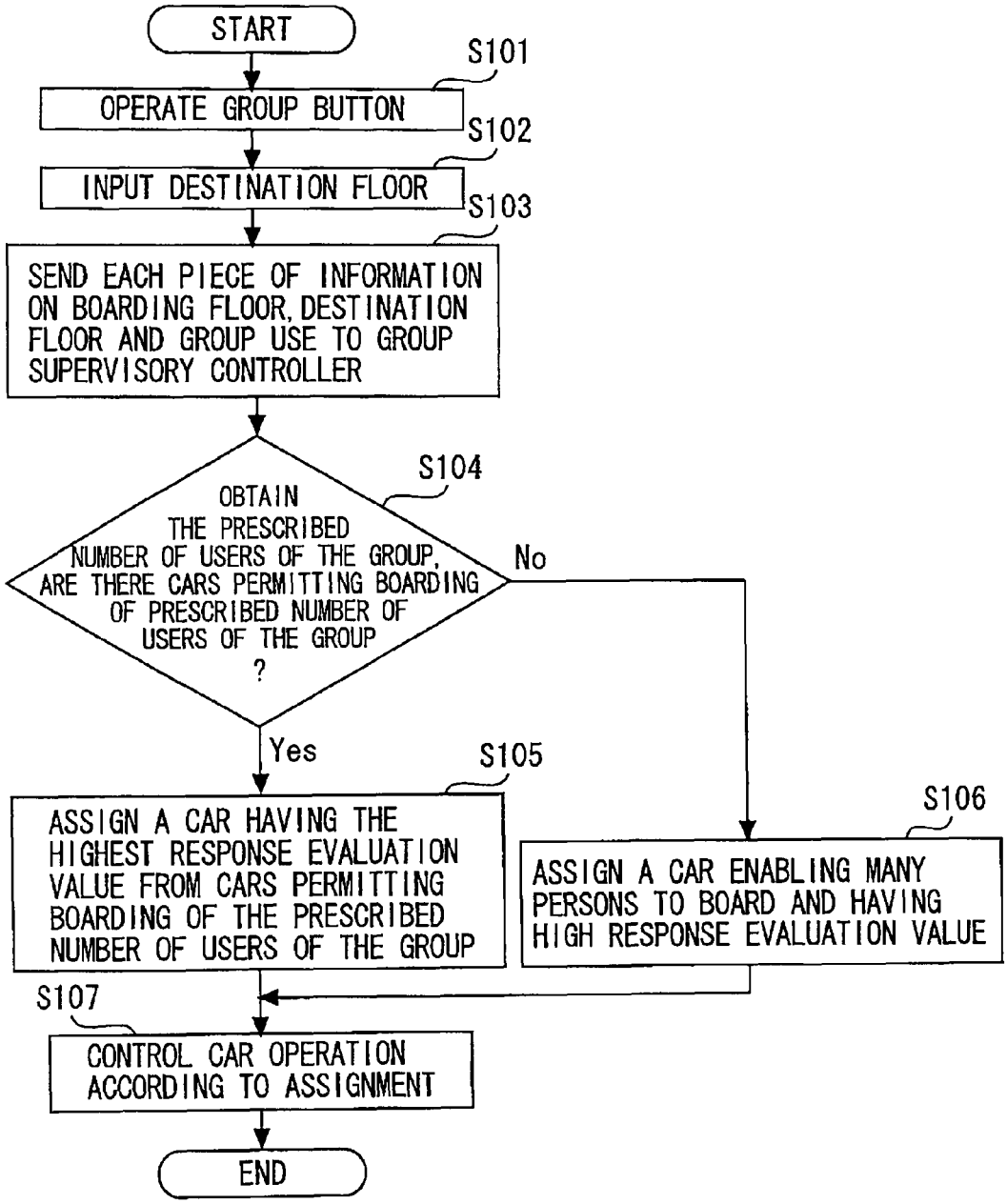
FIG. 2 is a flowchart showing the basic operation of the elevator group control system in the first embodiment according to the present invention.
Figure 3:
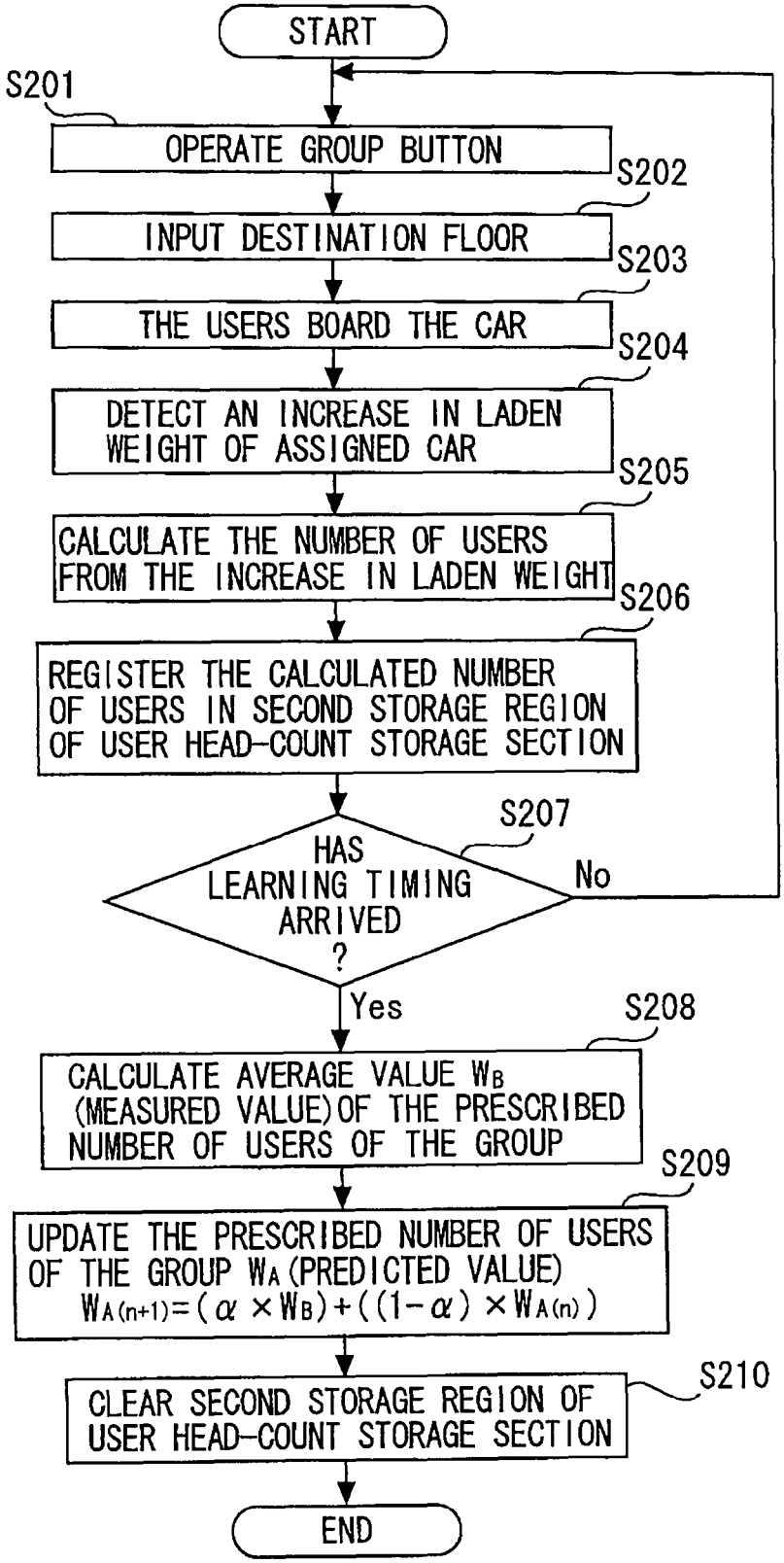
FIG. 3 is a flowchart showing other operations of the elevator group control system in the first embodiment according to the present invention.
Figure 4:
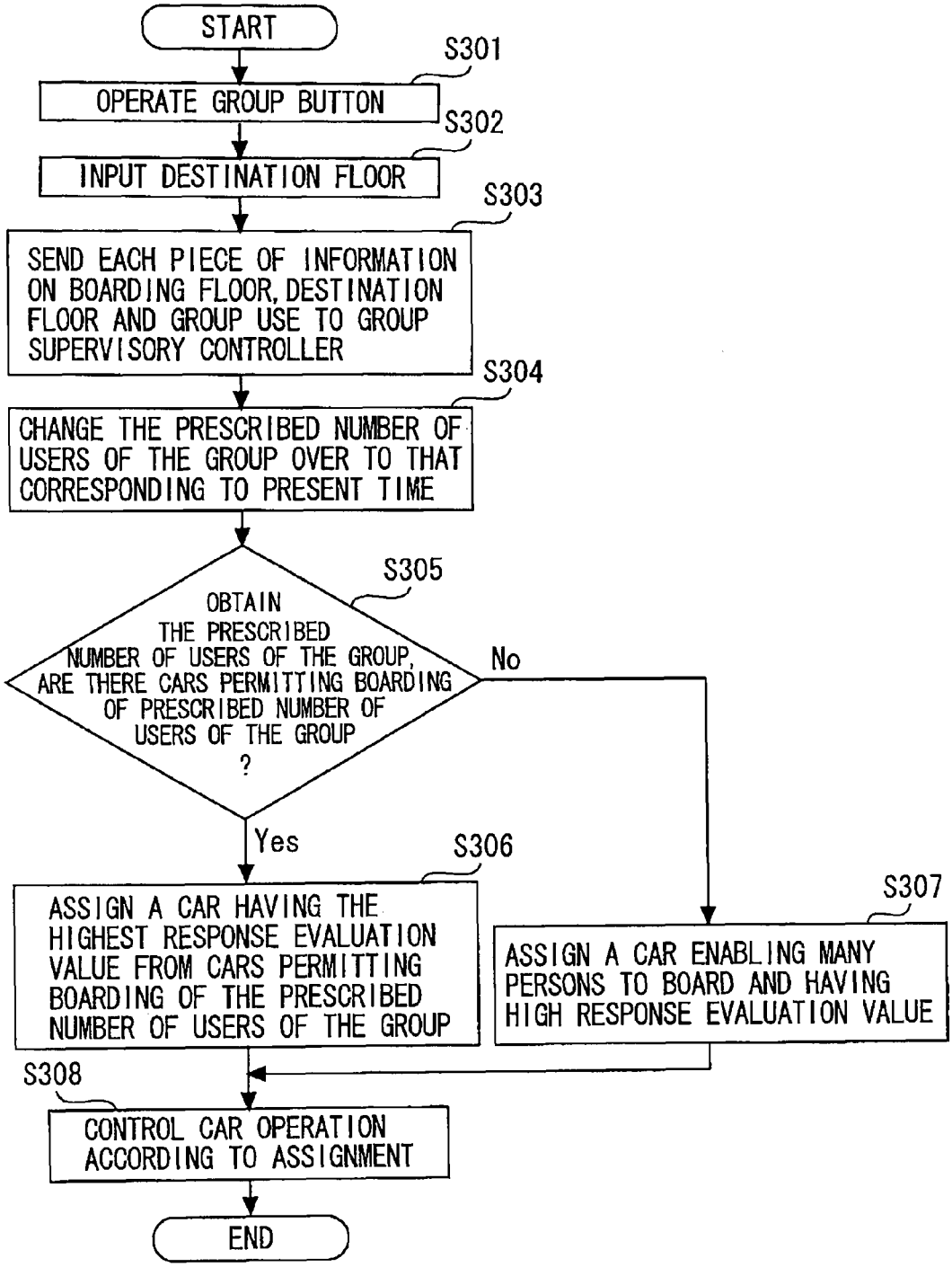
FIG. 4 is a flowchart showing other operations of the elevator group control system in the first embodiment according to the present invention.
Figure 5:
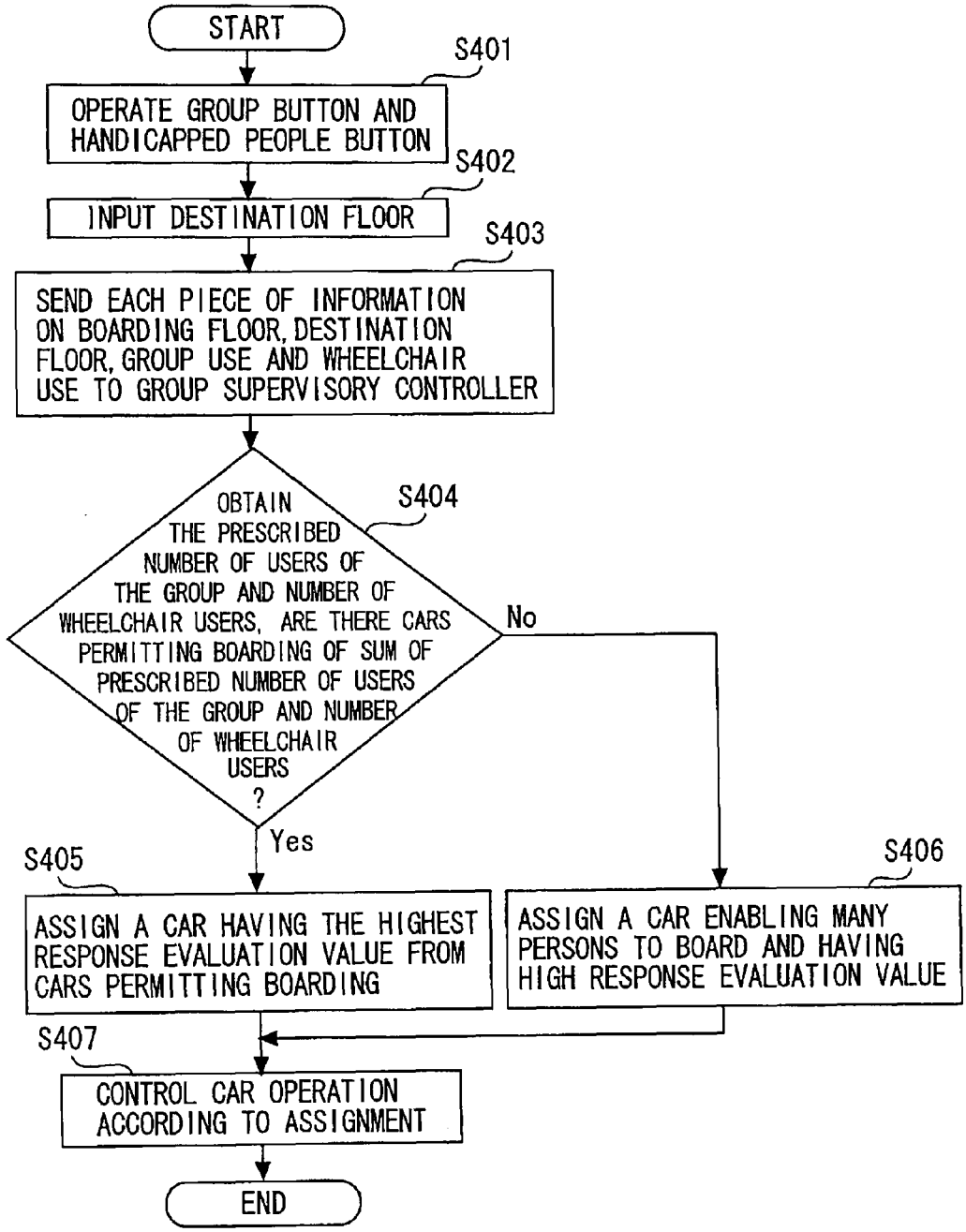
FIG. 5 is a flowchart showing other operations of the elevator group control system in the first embodiment according to the present invention.

FIG. 1 is a block diagram showing an elevator group control system in a first embodiment according to the present invention, FIG. 2 is a flowchart showing the basic operation of the elevator group control system in the first embodiment according to the present invention, and FIGS. 3 to 5 are flowcharts showing other operations of the elevator group control system in the first embodiment according to the present invention.

The elevator group control system shown in FIG. 1 has a function for group-controlling a plurality of elevators installed within the same building and the like. In FIG. 1, reference numeral 1 denotes a destination operating panel installed in a hall of each floor. The destination operating panel 1 has a function for elevator users to register their destination floors before boarding. That is, hall car calls are registered when users perform prescribed operations before boarding for the destination operating panel 1. Incidentally, FIG. 1 shows a case where destination operating buttons 2 bearing numerals 0 to 9 and the like are installed in the destination operating panel 1. In such a case, users register their destination floors (hall car calls) by operating these destination operating buttons 2.

Aside from the above-described destination operating buttons 2, the destination operating panel 1 provided in each hall is provided with a group button 3 and a handicapped people button 4. The group button 3 is a button to be operated in registering that users use an elevator as a group of a plurality of persons. That is, this group button 3 is composed of a group boarding registering device, and has a function for informing a group supervisory controller 5, which will be described later, that users will board in the elevator as a group of a plurality of persons.

The handicapped people button 4 is a button to be operated in registering that the elevator is used by a user using a wheelchair and the like. That is, this handicapped people button 4 is composed of a wheelchair boarding registering device, and has a function for informing the group supervisory controller 5 that the user uses a wheelchair and the like.

The group supervisory controller 5 is a device for group-controlling a plurality of elevators installed within the same building and the like. That is, the group supervisory controller 5 calculates a response evaluation value of each car on the basis of various kinds of information inputted from the destination operating panel 1 and the like, and assigns a hall car call to a car having the highest response evaluation value. And an elevator controller 6 performs the operation control of each elevator on the basis of operation instructions from the group supervisory controller 5.

Incidentally, reference numeral 7 shown in FIG. 1 denotes a car load detector provided so as to correspond to (the car of) each elevator. This car load detector 7 has a function for detecting the laden weight within a car, and is composed of for example, a load weighing device attached to the undersurface of a car platform, to an edge portion of a main rope and the like. Reference numeral 8 denotes a car load increase detection section provided in each controller 6. This car load increase detection section 8 has a function for detecting an increase in the car load which occurs before and after boarding of users on the basis of the car load detected by the car load detector 7.

The above-described group supervisory controller 5 is provided with a user head-count storage section 9, an assigned car determination section 10, a group user head-count calculating section 11, a user head-count learning section 12, and a time-zone-based user head-count changeover section 13. First, the basic function and operation of the above-described group supervisory controller 5 will be described on the basis of FIGS. 1 and 2.

The user head-count storage section 9 is provided with a plurality of storage regions, and the number of users expected when an elevator is used by users as a group is stored beforehand, for example, in a first storage region.

The assigned car determination section 10 has a function for assigning an optimum car to a hall car call. Concretely, the assigned car determination section 10 calculates the response evaluation value of each car on the basis of various kinds of information inputted from the destination operating panel 1 and the like, and assigns a hall car call to a car having the highest response evaluation value. The assigned car determination section 10 has also a function for determining a car to be assigned to a hall car call on the basis of the number of users stored in the first storage region of the user head-count storage section 9 when registration of a destination floor by use of the destination operating panel 1 has been performed at the same time with registration of a group use by use of the group button 3.

In the following, concrete basic operations will be described on the basis of FIG. 2.

When users use an elevator as a group of a plurality of persons, a representative of the group performs the registration of a group use in a hall by operating the group button 3 (S101) and inputs thereafter the destination floor of the group by operating the destination operating button 2 (S102). When the above-described input operations by the representative are finished, the destination operating panel 1 sends the input information, i.e., each piece of information on the boarding floor, destination floor and group use to the group supervisory controller 5 (S103).

In the group supervisory controller 5, through the input of the information on the group use along with a hall car call (each piece of information on the boarding floor and the destination floor) from a destination operating panel 1, the assigned car determination section 10 obtains the number of users stored beforehand from the first region of the user head-count storage section 9, and performs a retrieval as to whether there are cars which permit the boarding of the number of users (S104). That is, the assigned car determination section 10 makes a judgment for all cars as to whether there is a vacancy for the above-described number of users.

When it is judged in S104 that there are cars permitting the boarding, the assigned car determination section 10 calculates a response evaluation value for each car having the vacancy for the above-described number of users, and assigns a car having the highest response evaluation value among the cars to the hall car call registered in S102 (S105). On the other hand, when it is judged in S104 that there is no car permitting the boarding, the assigned car determination section 10 calculates response evaluation values for all cars, and performs assignment to the hall car call registered in S102 in consideration of both the number of persons enabled to board and the response evaluation values. That is, the assigned car determination section 10 assigns the hall car call to a car enabling many persons to board and having a high response evaluation value (S106).

And the elevator controller 6 controls the operation of each car according to the assignment in S105 or S106 (S107).

According to such a configuration, even when users use an elevator as a group of a plurality of persons, it is not necessary to confirm the number of users before boarding, and it is possible to perform the registration of a group use only by a simple operation of pressing the group button 3. Because the number of users expected when the group button 3 is pressed is set beforehand in the user head-count storage section 9 and when there is no car permitting the boarding of that number of users, a hall car call is assigned to a car enabling many persons to board and having a high response evaluation value, there is no possibility that the waiting time of users might become long, and it becomes possible to provide a group control system excellent in operation efficiency.

Next, the above-described head-count learning function will be described.

In order to realize this learning function, the group supervisory controller 5 is provided with the above-described group user head-count calculating section 11 and user head-count learning section 12, and the user head-count storage section 9 is provided with a second storage region for storing various kinds of learning information.

The group user head-count calculating section 11 has a function for calculating the number of users for whom a group use has been registered by use of the group button 3, on the basis of information from the car load increase detection section 8. Concretely, when the users for whom a group use has been registered by use of the group button 3 board an assigned car, the car load detector 7 detects the car load before boarding and the car load after boarding, and an increase in the car load before and after boarding is detected by the car load increase detection section 8. The group user head-count calculating section 11 calculates the concrete number of users of the group on the basis of the increase in the car load detected by the car load increase detection section 8.

The user head-count learning section 12 optimizes (updates) the number of users stored in the first region of the user head-count storage section 9 on the basis of the number of users calculated by the group user head-count calculating section 11.

In the following, concrete learning operations will be described on the basis of FIG. 3.

Because the operations shown in S201 and S202 of FIG. 3 are the same as those shown in S101 and S102 of FIG. 2, the description thereof is omitted. When a car has been assigned to a hall car call accompanied by the registration of a group use, the car load increase detection section 8 of the controller 6 which controls the assigned car obtains the car load of the assigned car immediately before the boarding of the users for whom a hall car call has been registered in S202. When the users have boarded (S203), the car load increase detection section 8 obtains the car load of the assigned car also immediately after boarding. And the car load increase detection section 8 detects an increase in the car load occurring due to the boarding of the users on the basis of the above-described car load obtained before and after the boarding of the users (S204).

When an increase in the car load is detected in S204, the group user head-count calculating section 11 calculates the number of users (an estimated value) who boarded at S203 by dividing the increase in the car load by prescribed average body weight (S205). Also, the group user head-count calculating section 11 sends the calculation result (an estimated value) of S205 to the user head-count storage section 9, and causes the calculation result to be stored in the above-described second region (S206).

Incidentally, the learning timing for optimizing (updating) the number of users stored in the first region of the user head-count storage section 9 is set beforehand in the user head-count learning section 12. For example, when the number of users in the first region is to be updated once a day, a prescribed time (for example, 12:00 midnight when the date changes) is set as learning timing. That is, through a change in present time to 12:00 midnight, the operation for optimizing the number of users is started. Therefore, the flow of operation returns to S201 (No of S207) until the next learning timing arrives and the operations of S201 to S205 are repeated. That is, each time a car is assigned to a hall car call accompanied by the registration of a group use, the number of users (an estimated value) is stored in the second region of the user head-count storage section 9.

When the learning timing has arrived (Yes of S207), the user head-count learning section 12 starts an operation for optimizing the number of users in the first region of the user head-count storage section 9. Concretely, first, the user head-count learning section 12 calculates an average value $W_B$ of the number of users stored in the second region of the user head-count storage section 9 (the number of users calculated in S205) (S208). And the user head-count learning section 12 updates the number of users stored in the first region of the user head-count storage section 9 on the basis of the following formula by using the obtained average value $W_E$, (S209).

$$W_{A(n+1)}=(\alpha\times W_B)+((1-\alpha)\times W_{A(n)})$$

where, $W_A$: Predicted value of the number of users who board by operating the group button 3

$W_B$: Measured value of the number of users who board by operating the group button 3 (average value)

$\alpha$: Weight of user learning ($0<\alpha<1$)

The value of weight of user learning $\alpha$ is appropriately set by using, for example, a simulation etc. Incidentally, the above-described a means that the larger the value, the more importance will be attached to a recent condition.

And after the updating of the number of users in the above-described first region is finished, the second region of the user head-count storage section 9 is cleared (S210).

According to the above-described configuration, it is possible to appropriately update the number of users to be stored in the first region of the user head-count storage section 9 so as to be adaptable to recent information. For this reason, when the group button 3 has been pressed, it becomes possible to provide the most suitable car having a vacancy for the number of persons. Incidentally, the method shown in FIG. 3 shows an example of the learning functions, and other methods may be used.

The learning functions may also be configured in such a manner that they are individually carried out so as to be adaptable to a destination floor to be reached when the group button 3 is pressed. In such a case, the number of users is stored for each destination floor of an elevator in the first region of the user head-count storage section 9. And the user head-count learning section 12 optimizes (updates) the number of users stored in the first region of the user head-count storage section 9 for each destination floor of the elevator. That is, the flow of operations shown in FIG. 3 is carried out for each destination floor of the elevator.

Next, a description will be given of a function for changing over the number of users used by the assigned car determination section 10 so as to be adaptable to the condition of an elevator and the like.

In order to realize this function for changing over the number of users, the group supervisory controller 5 is provided with the above-described time-zone-based user head-count changeover section 13. In the first region of the user head-count storage section 9, the number of users is stored, for example, for each prescribed time zone.

The time-zone-based user head-count changeover section 13 has a function for setting the number of users by changing the number of users used by the assigned car determination section 10 over to one of a plurality of numbers of users stored in the first region of the user head-count storage section 9 when the group button 3 is pressed. That is, the time-zone-based user head-count changeover section 13 changes the number of users used by the assigned car determination section 10 over to a corresponding value for each of the prescribed time zones.

In the following, concrete changing operations will be described on the basis of FIG. 4.

Because the operations shown in S301 to S303 of FIG. 4 are the same as those shown in S101 to S103 of FIG. 2, the description thereof is omitted. In the group supervisory controller 5, through the input of information of a group use along with a hall car call from the destination operating panel 1, first, the time-zone-based user head-count changeover section 13 changes the number of users stored in the first region of the user head-count storage section 9 over to the number of users corresponding to the present time (S304). That is, the assigned car determination section 10 obtains the number of users changed over by the time-zone-based user head-count change over section 13, and carries out the operations of S305 and after on the basis of the obtained number of users. Incidentally, because the operations shown in S305 to S308 of FIG. 4 are the same as those shown in S104 to S107 of FIG. 2, the description thereof is omitted.

According to such a configuration, it is possible to set, for each prescribed time zone, the number of users expected when the group button 3 is pressed. The frequency of using elevators changes greatly depending on time zones and for example, the frequency of using elevators is high in prescribed time zones, such as times around the start and end of business hours, and lunchtime, for example. For this reason, according to the above-described configuration, it becomes possible to provide optimum services according to the time at which the group button 3 is pressed. That is, it becomes possible to assign the most suitable car having a vacancy for the number of users to a hall car call.

Incidentally, even when the number of users is stored for each prescribed time zone in the first region of the user head-count storage section 9, it is possible to apply the above-described learning function. In such a case, the user head-count learning section 12 optimizes (updates) the number of users stored in the first region for each of the above-described prescribed time zones on the basis of the number of users for each of the above-described prescribed time zones stored in the second region of the user head-count storage section 9. That is, it is necessary only that the flow of operations shown in FIG. 3 be carried out for each of the above-described prescribed time zones.

Next, a description will be given of a case where both of the group button 3 and the handicapped people button 4 are pressed.

In preparation for such a case, the user head-count storage section 9 is such that in addition to the number of users (a first number of users) in the first storage region, the number of users expected when users using a wheelchair use the elevator (a second number of users) is stored in a third storage region. When the registration of a destination floor by use of the destination operating panel 1 has been performed at the same time with group use registration by the group button 3 and the registration of a wheelchair use by use of the handicapped people button 4, the assigned car determination section 10 determines a car to be assigned to the hall car call on the basis of a sum of the above-described first and second numbers of users stored in the user head-count storage section 9.

In the following, concrete operations when both of buttons 3 and 4 are pressed will be described on the basis of FIG. 5.

When a plurality of users including wheelchair users use an elevator as a group, first, a representative of the group performs the registration of a group use and the registration of a wheelchair use by operating the group button 3 and the handicapped people button 4 in the hall (S401). The representative inputs a destination floor of the group by operating the destination operating button 2 (S402). When the input operations by the representative are finished, the destination operating panel 1 sends the input information, i.e., each piece of information on the boarding floor, destination floor, group use and wheelchair use to the group supervisory controller 5 (S403).

Through the input of the information on the group use and wheelchair use along with a hall car call from the destination operating panel 1, in the group supervisory controller 5, first, the assigned car determination section 10 obtains the above-described first number of users and second number of users from the first and third regions of the user head-count storage section 9. And the assigned car determination section 10 performs a retrieval as to whether there are cars permitting the boarding of a total of users as a sum of the obtained first and second numbers of users (S404). That is, the assigned car determination section 10 makes a judgment for all cars as to whether there is a vacancy for the total of the above-described number of users.

Incidentally, because the operations shown in S405 to S407 are the same as those shown in S105 to S107 of FIG. 2, the description thereof is omitted.

According to such a configuration, when a plurality of users including wheelchair users use an elevator as a group, it becomes possible to assign a car for which the boarding space of wheelchair users is also taken into consideration, and it becomes possible to provide the most suitable car having a vacancy for the number of persons and wheelchairs.

According to the embodiment of the present invention, as described above, in an elevator group control system which group-controls a plurality of elevators, it becomes possible to ensure excellent convenience and to positively prevent a decrease in operation efficiency even when a group of a plurality of persons uses an elevator.

INDUSTRIAL APPLICABILITY

The elevator group control system related to the present invention can be applied to a system in which a plurality of elevators are group-controlled and which enables a destination floor and a group use to be registered before boarding.

The invention claimed is:

1. An elevator group control system which group-controls a plurality of elevators, comprising:

a destination operating panel which is provided in an elevator hall and from which users register their destination floors before boarding;

a group boarding registering device for registering that users will use an elevator as a group, which is provided in the hall;

a user head-count storage section in which the number of users expected when an elevator is used by users as a group is stored beforehand; and an assigned car determination section which determines a car to be assigned to a hall car call on the basis of the number of users stored in the user head-count storage section when registration of a destination floor by use of the destination operating panel has been performed at the same time with registration of a group use by use of the group boarding registering device.

2. The elevator group control system according to claim 1, further comprising:

an car load detector which detects the car load of each elevator;

an car load increase detection section which detects an increase in the car load which occurs before and after boarding on the basis of the car load of an assigned car detected by the car load detector when users for whom a group use has been registered from the group boarding registering device have boarded the assigned car; and a user head-count learning section which optimizes the number of users stored in the user head-count storage section on the basis of the increase in the car load detected by the car load increase detection section.

3. The elevator group control system according to claim 2, wherein:

the user head-count storage section is such that the number of users is stored for each destination floor of an elevator; and the user head-count learning section optimizes the number of users stored in the user head-count storage section for each destination floor of an elevator.

4. The elevator group control system according to claim 1, further comprising:

a user head-count changeover section which sets the number of users by changing the number of users used by the assigned car determination section over to one of a plurality of numbers of users stored in the user head-count storage section, wherein:

the user head-count storage section is such that the number of users is stored for each prescribed time zone; and the user head-count changeover section changes the number of users used by the assigned car determination section over to a corresponding value for each prescribed time zone.

5. The elevator group control system according to claim 4, further comprising:

an car load detector which detects the car load of each elevator;

an car load increase detection section which detects an increase in the car load which occurs before and after boarding on the basis of the car load of the assigned car detected by the car load detector when users for whom a group use has been registered from the group boarding registering device have boarded the assigned car; and a user head-count learning section which optimizes the number of users stored in the user head-count storage section for each prescribed time zone on the basis of the increase in the car load detected by the car load increase detection section.

6. The elevator group control system according to claim 1, further comprising:

a wheelchair boarding registering device for registering that a user using a wheelchair will use an elevator, which is provided in the hall of an elevator, wherein:

the user head-count storage section is such that a first number of users expected when the users use an elevator as a group and a second number of users expected when users using a wheelchair use an elevator are stored; and the assigned car determination section is such that when registration of a destination floor by use of the destination operating panel is performed at the same time with registration of a group use by use of the group boarding registering device and registration of a wheelchair use by use of the wheelchair boarding registering device, a car assigned to a hall car call is determined on the basis of a sum of the first number of users and second number of users stored in the user head-count storage section.

7. The elevator group control system according to claim 1, wherein the assigned car determination section assigns a hall car call to a car having a highest response evaluation value among cars having a vacancy for the number of users, which are stored in the user head-count storage section, when registration of a destination floor by use of a destination operating panel has been performed at the same time with registration of a group use by use of the group boarding registering device.

8. The elevator group control system according to claim 7, wherein in a case where registration of a destination floor by use of the destination operating panel has been performed at the same time with registration of a group use by use of the group boarding registering device, the assigned car determination section determines a car to be assigned to a hall car call on the basis of both of the number of persons capable of boarding and a prescribed response evaluation value when for all cars, there is no vacancy for the number of users stored in the user head-count storage section.

* * * * *